US005363599A

United States Patent [19]

Dischler

[11] Patent Number: 5,363,599

[45] Date of Patent: Nov. 15, 1994

[54] METHOD AND APPARATUS FOR MODIFICATION OF TEXTURE AND APPEARANCE OF TEXTILE FABRICS

[75] Inventor: Louis Dischler, Spartanburg, S.C.

[73] Assignee: Milliken Research Corporation, Spartanburg, S.C.

[21] Appl. No.: 596,271

[22] Filed: Oct. 12, 1990

[51] Int. Cl.[5] ..... B24B 31/00

[52] U.S. Cl. ..... 451/326; 451/36; 34/155; 241/39; 68/20

[58] Field of Search ..... 51/163.1, 163.2, 313, 51/164.1; 34/43, 155, 156; 241/39; 26/25, 26, 18.5, 19, 20, 21, 22, 23, 24; 68/20

[56] References Cited

U.S. PATENT DOCUMENTS 2,612,705 10/1952 Kauffman, II ..... 34/43
4,248,387 2/1981 Andrews ..... 241/39
4,307,544 12/1981 Balz ..... 51/313

FOREIGN PATENT DOCUMENTS 0192745 11/1983 Japan ..... 51/163.1

*Primary Examiner*—Bruce M. Kisliuk
*Assistant Examiner*—Eileen P. Morgan
*Attorney, Agent, or Firm*—Kevin M. Kercher; Terry T. Moyer

[57] ABSTRACT

A method and apparatus for treatment of materials in order to modify the texture and appearance. This is created by application of one or more gas jets directed away from the interior curved surface of a cylinder, generating a vortex which rapidly and repeatedly cycles the substrate at low tension past the gas jets. The rapid vibrations generated in the substrate by the jets serve to break apart fiber to fiber bonds caused by finish and loosen up the structure of the yarns and that of the substrate. This creates a desired aged appearance as well as a very soft texture.

36 Claims, 3 Drawing Sheets

METHOD AND APPARATUS FOR MODIFICATION OF TEXTURE AND APPEARANCE OF TEXTILE FABRICS

BACKGROUND OF THE INVENTION

This invention relates to improved method and apparatus for giving material an aged appearance and more particularly, to provide a method and apparatus for cleaning, abrading, scraping, puncturing or otherwise working fabrics or garments in order to modify the appearance, smoothness, coefficient of friction, handle, drape, and other related fabric proprieties.

In recent years, the commercial process of providing garments, particularly denim, with an aged or distressed appearance has been found to be highly desirable by many consumers. In the past denim has been commercially faded by subjecting the denim to either a chemical bath or to abrasive particulates or both in combination. A popular method is to use pumice saturated with a bleaching agent. This saturated pumice is added to the wash cycle to obtain an uneven faded or scuffed look which almost passes for natural wear. Numerous variations of this process have been practiced with the use of enzymes or acids instead of bleach as well as ceramics, rubber balls or sand instead of pumice. An example of this is U.S. Pat. No. 4,765,100 which discloses preformed sand and resin bonded abrasive elements mixed with denim jeans and tumbled within an elongate drum. Another variation is to pretreat the fabric by sand or shot blasting prior to treatment by chemicals or abrasives. This treatment is used to accelerate the aging and distressing of the fabric.

A major problem with the current means of altering fabric texture and appearance is that the large stones used in the process, along with the very abrasive particulate generated during processing, are very deleterious to equipment, and in addition, require manual removal from the processed garments due to the tendency of the smaller particles to accumulate in pockets and interior surfaces.

Another problem is that the washing process itself is very time consuming and increases the cost of manufacturing the garment to a significant degree.

A further problem is that this abrasive washing process is very inexact. Due to the variables involved, the final appearance of the garment is not consistent. Moreover, the combination of chemical and abrasive treatment degrades the fabric strength and reduces the garment life.

The present invention solves the above problems in a manner not disclosed in the known prior art.

SUMMARY OF THE INVENTION

An apparatus and method for modifying the texture and appearance of material which comprises a closed hollow cylinder having an interior surface with curved walls and a means for material entry and exit to said hollow cylinder and at least one gas jet directed away from the interior of the curved wall of said cylinder and an air exhaust means for said hollow cylinder. The one or more gas jets create a vortex that rapidly and repeatedly cycles the material at low tension past the gas jets. The rapid vibrations generated in the material by the jet(s) serve to break apart fiber to fiber bonds caused by finish and loosen up the structure of the yarns and that of the material.

An advantage of this invention is that the desired aged appearance is obtained as well as a very soft texture that is superior to that which can be obtained by stone washing.

It is another advantage of this invention is that no abrasives need to be removed from either the materials or equipment after processing, although abrasives can be used as an option.

Yet another advantage of this invention is the minimal time required when contrasted to abrasion or washing processes.

Still another advantage of this invention is that the final result is very exact depending on the control of variables such as time and air pressure.

Another advantage of this invention is that the material is not degraded due to combination of chemicals and abrasives.

These and other advantages will be in part obvious and in part pointed out below.

BRIEF DESCRIPTION OF THE DRAWINGS

The above as well as other objects of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
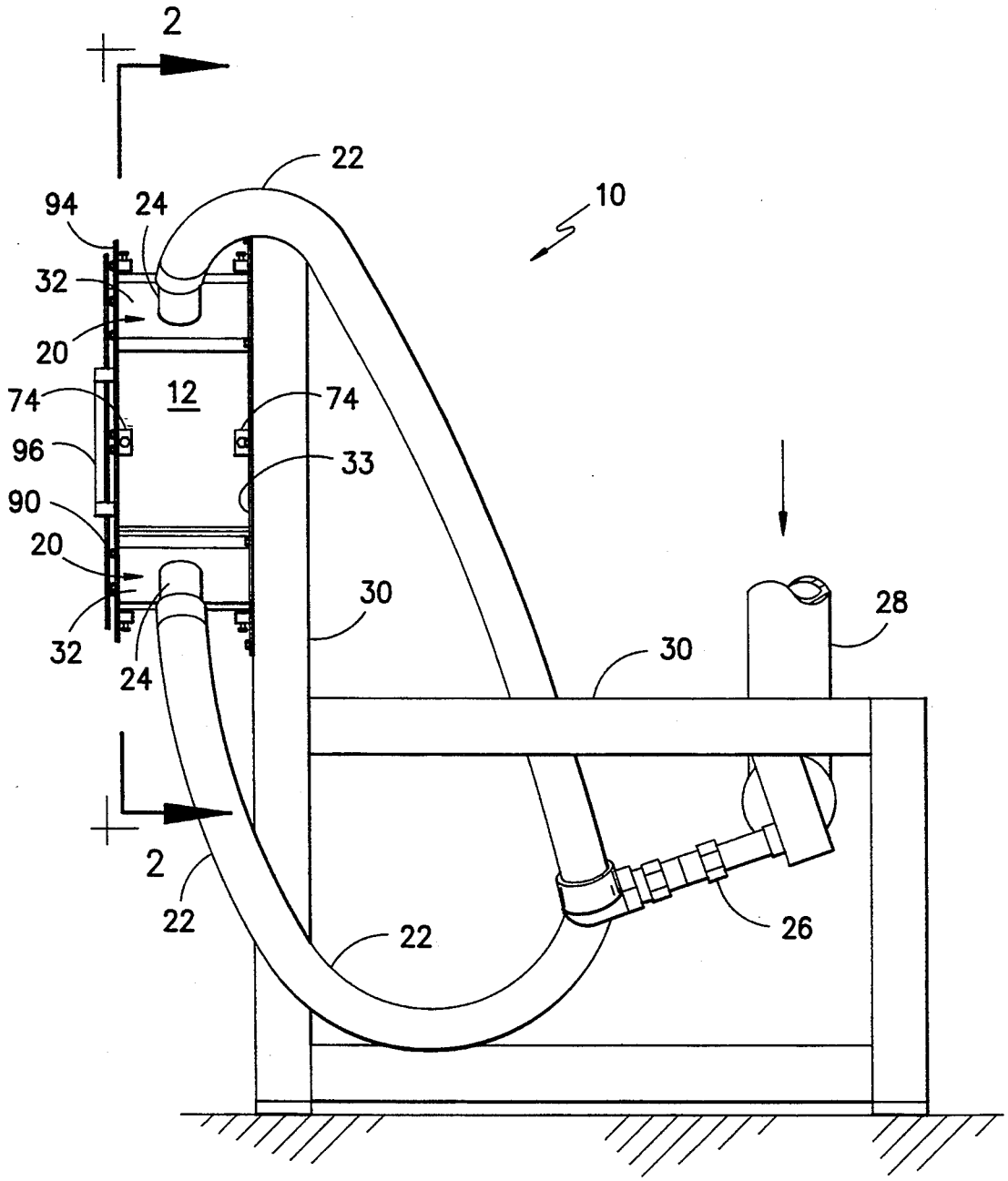
FIG. 1 is a side elevational view of the single vortex assembly and air supply means.
Figure 2:
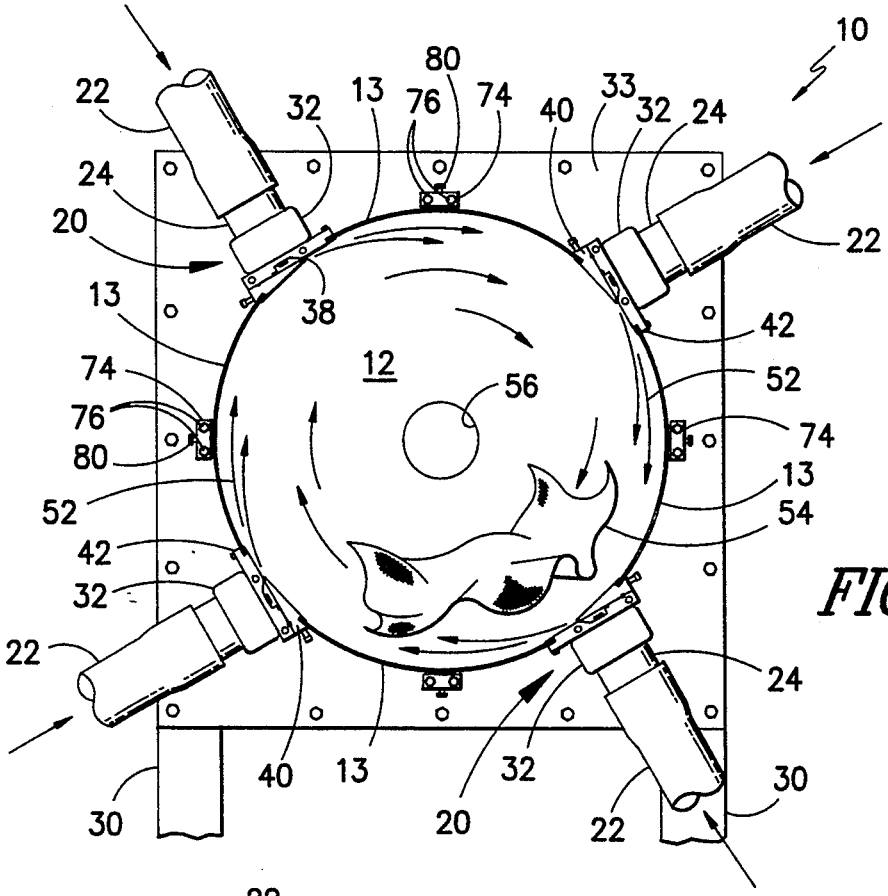
FIG. 2 is a cross-sectional view of a single vortex assembly taken along line 2—2 of FIG. 1 and constructed in accordance with the present invention.
Figure 3:
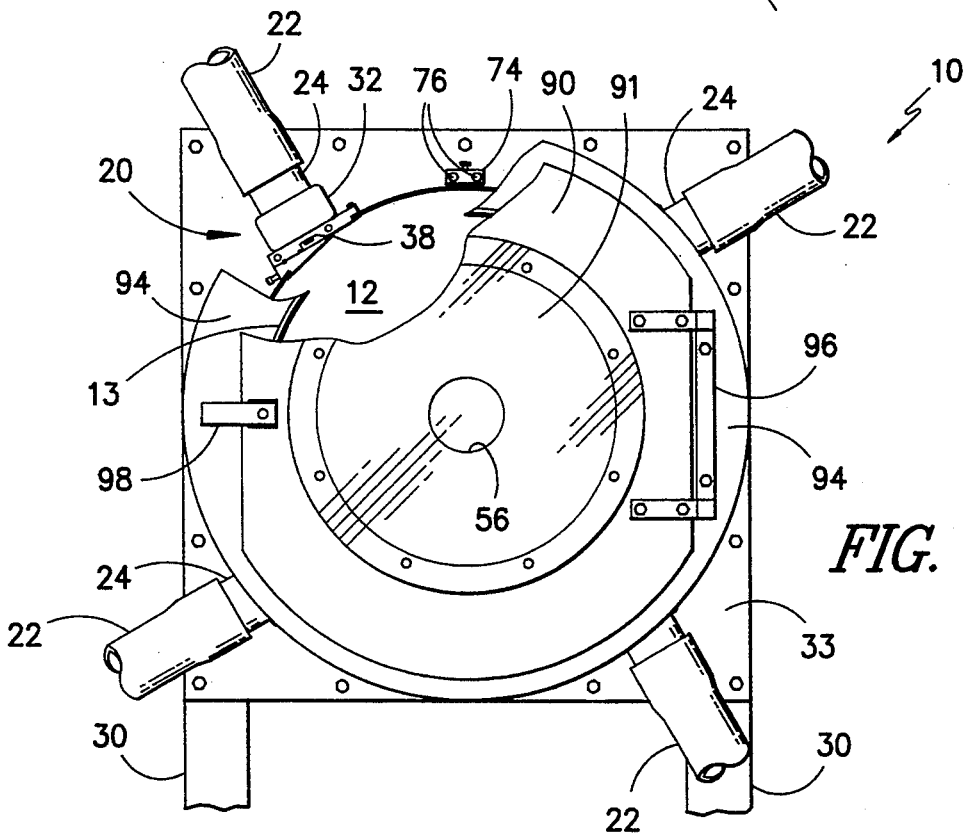
FIG. 3 is a fragmentary front elevational view of a single vortex assembly of FIG. 1 disclosing the cover, cover support plate and a gas jet.

Referring now by reference numerals to the drawings, and first to FIGS. 1–4, a single vortex material treatment assembly is indicated generally by numeral 10. This assembly 10 comprises a hollow cylinder 12, the curved wall of which is defined by curved plates 13, top plates 40 and base plates 42, as shown in FIGS. 1, 2 and 3. The curved plates 13 of the hollow cylinder 12, as well as all other components of the present invention not delineated to the contrary, can be constructed out of a variety of materials such as various metals, durable plastics, ceramics and so forth with the preferred material being steel. There are four gas jet assemblies, indicated generally as numeral 20 spaced at equal distances from each other along the circumference of the hollow cylinder 12.

As shown in FIG. 1, gas is supplied to the gas jet assemblies by gas hoses 22, preferable constructed out of rubber or any flexible material that can carry gas at high pressure. The gas hoses 22 are attached over a tube inlet 24 to provide gas into the gas jet assembly 20. Each hose 22 connects to a single distribution manifold 26 which supplies gas from a second larger gas supply line 28. This distribution manifold 26, a conventional gas tube interconnection, is attached to the support frame 30 that is for the entire assembly 10.

Figure 4:
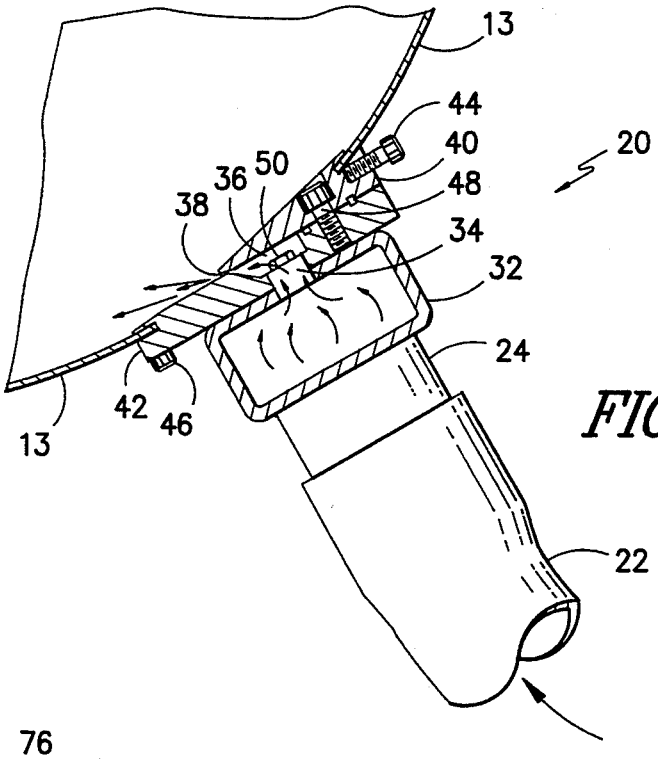
FIG. 4 is a cross-sectional view of one of the gas jets shown in FIG. 1 employed in practicing the present invention.

Referring now to FIG. 4, gas is supplied from tube inlet 24 into the manifold 32 that supplies pressurized gas to through passage 34 which communicates with submanifold 36 that ejects the gas by means of a converging/diverging nozzle 38. This converging/diverging nozzle 38 is formed by top plate 40 and base plate 42. Both of these plates 40 and 42 are attached to the curved plates 13 by means of locking screws 44 and 46 respectively. The top plate 40 is fastened to the base plate 42 by means of screw 48. The manifold 32 is fastened to the base plate 42 by means of screw 50. Any equivalent structure which creates a gas nozzle tangential to the interior of the curved surface may be used.

Referring now to FIG. 2, the gas jet assembly propels gas at a direction substantially tangential to the interior surface of the hollow cylinder 12 as shown by numeral 52. The gas used is typically air compressed to 30 p.s.i., however, depending on the sensitivity of the textile fabric to be treated, this pressure can be varied between 5 to 120 p.s.i. It is found that this process is most effective when the air used to treat the garments is heated substantially above room temperature. It has been found that 350 degrees Fahrenheit is the practical limit for most textile fabrics. However, the entire range is defined as between the glass transition temperature and the melting point of the textile fabric.

As shown in FIGS. 2 and 3, the gas jet assemblies 20 serve the dual purpose of propelling the fabric 54 around the inside of the hollow cylinder 12 and simultaneously vibrating the garment as it passes over the nozzle 38. The fabric 54 is treated four times each revolution as it is driven clockwise within the hollow cylinder 12 at a rate of about 25 revolutions per second. The fabric 54 makes a combined sliding, impacting, and rolling motion while traversing the interior surface of the cylinder 12, which defines the outer perimeter of the vortex. The tangential gas lines indicated by 52 flow at sonic velocity or even higher. Exhaust air, lint and other debris escape through the central port 56.

When the material 54 comes in contact with the tangential gas jets 52, it will cause the material 54 to vibrate violently. These vibrations take the form of saw-toothed waves that travel rapidly down the material 54 with small bending radii and high speed combining to break apart fiber to fiber bonds created by finish or sizing.

In addition, the structure of the material 54 is loosened as well as any component yarn that may be present in the material 54. With enough treatment, the material 54 can disintegrate back to its original state of loose fibers.

The curved plates 13 are restrained against the radially directed force generated by the rapidly cycling material 54 by blocks 74 that are fastened to both a front support plate 94 and a back support plate 33 by dual bolts 76. The back support plate 33 is attached to the support frame 30. There is a bolt 80 perpendicular to the curved plate 13 which locks said plate 13 in a fixed location. There are two sets of four of these blocks 74 equidistantly spaced around the circumference of the hollow cylinder 12.

Referring now to FIG. 3, the front support plate 94 is attached to the base plate 42. A cover 90 is attached by a hinge 96 to the front support plate 94. There is also a latch 98 which can fasten the cover 90 to the front support plate 94 and is located on the opposite side of the cover 90 from the hinge 96. The cover 90, in the preferred embodiment, has a viewing port 91 constructed out of glass, plastic or similar material.

In addition to the direct action of the gas jets, the material 54 is treated by a combination of rolling, sliding and impacting with the walls of hollow cylinder 12. It can be appreciated that is the smooth surface of these walls is broken up by the placement of knobs, abrasive material or protrusions, the ageing process will be greatly accelerated. An example of a protrusion is indicated by numeral 103 in FIG. 4 and the inside of the cylinder wall can be abrasive as indicated by numeral 102 found in FIG. 3. Small particles, such as small metal balls, wire portions, rubber, plastic, or wood and so forth, when added to the cylinder 12 will accelerate to a higher speed than the material 54 which is indicated by numeral 105 on FIG. 2. The relative velocity of small metal particles will be high enough to cause the particles to completely penetrate the material 54 giving it a "buckshot" appearance. Similarly, adding sand to the vortex will give material 54 a "sandblasted" look.

An aspect of this invention to consider is that metal parts such as buttons and zippers can be destroyed by this process in a few seconds. Furthermore, burrs raised by metal to metal impacts can loosen seams in the material 54. Covering the inside of the hollow cylinder 12 with rubber or its equivalent, alleviates this problem. The wall of the hollow cylinder can be resilient as shown by numeral 101 in FIG. 2. Alternatively, buttons or zippers may be added to the garment after treatment.

Figure 5:
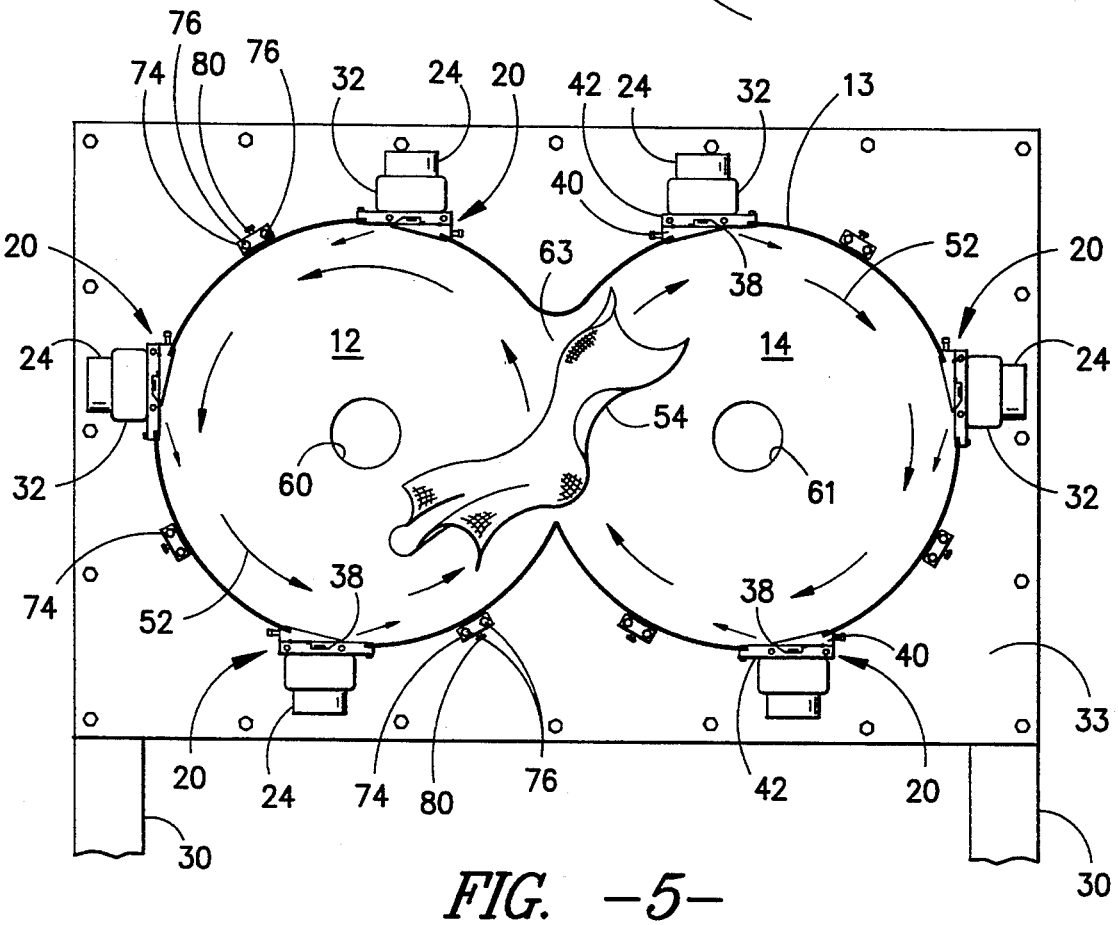
FIG. 5 is a cross-sectional view of an alternative embodiment of a dual vortex assembly.

In the alternative, a second hollow cylinder 14, which is a mirror image of the first hollow cylinder 12, can be attached to intersect and provide common area 63, as shown in FIG. 5. This prevents roll-up and tangle of the material 54 by reversing the direction of rotation of the material 54 once each cycle. The air supply in each hollow cylinder 12 and 14 is equal, so there is very little transfer of air from one vortex to another without the material 54 present. The material 54 is pressed against the interior of the cylinder 12 by centrifugal force. When the material 54 enters the common area 63, it is no longer coerced by the cylinder wall 12 to cycle in the first vortex. The material 54 continues on a tangent directly into the second vortex of hollow cylinder 14 and then cycles back to the first vortex of hollow cylinder 12 after completing a figure eight pattern. Any rotation in the vortex of hollow cylinder 12 is undone by counter rotation in the vortex of hollow cylinder 14. Each hollow cylinder 12, 14 has a port 60 and 61 respectively, to allow for the escape of excess air, lint or debris.

It is not intended that the scope of the invention be limited to the specific embodiment illustrated and described. Rather, it is intended that the scope of the invention be defined by the appended claims and their equivalents.

What is claimed is:

1. An apparatus for modifying the texture and appearance of textile fabric which comprises:

(a) a closed hollow cylinder having an interior surface with curved walls;

(b) means for textile fabric entry and exit to said hollow cylinder;

(c) at least one gas jet attached to said curved walls for the purpose of propelling gas directed away from the interior of the curved wall of said cylinder for propelling said textile fabric around the inside of said cylinder; and (d) an air exhaust means for said hollow cylinder.

2. The apparatus according to claim 1, wherein said gas jet is directed substantially tangential to the interior of the curved wall of said cylinder.

3. An apparatus as recited in claim 1, wherein said gas jet is for propelling gas within said hollow cylinder.

4. An apparatus as recited in claim 3, wherein said gas is steam.

5. The apparatus according to claim 1, wherein said interior surface of said cylinder is resilient for protecting metal parts attached to said textile fabric.

6. The apparatus according to claim 1, wherein said interior surface of said cylinder is abrasive for accelerating said modification of texture and appearance of said textile fabric thereby creating an aged, distressed appearance in said textile fabric.

7. The apparatus according to claim 1, wherein at least one protrusion is secured to the said interior surface of said cylinder for accelerating said modification of texture and appearance of said textile fabric thereby creating an aged, distressed appearance in said textile fabric.

8. An apparatus as recited in claim 1, wherein said gas is heated for increasing effectiveness of said modification of texture and appearance of said textile fabric.

9. An apparatus as recited in claim 8, wherein said temperature of the heated gas is between the glass transition temperature and the melting point of the textile fabric.

10. An apparatus for modifying the texture and appearance of textile fabric which comprises:

(a) a plurality of closed hollow cylinders which intersect to have a closed common area;

(b) said hollow cylinders having interior surfaces with curved walls;

(c) means for textile fabric entry and exit to said hollow cylinders;

(d) at least on gas jet attached to said curved walls for the purpose of propelling gas directed substantially tangential to the interior of the curved wall of at least one of said cylinders for propelling said textile fabric around the inside of said cylinders; and (d) at least one gas exhaust means for said hollow cylinders.

11. The apparatus according to claim 10, wherein said interior surfaces of said cylinders are resilient for protecting metal parts attached to said textile fabric.

12. The apparatus according to claim 10, wherein said interior surfaces of said cylinders are abrasive for accelerating said modification of texture and appearance of said textile fabric thereby creating an aged, distressed appearance in said textile fabric.

13. The apparatus according to claim 10, wherein at least one protrusion is secured to the said interior surface of said cylinders for accelerating said modification of texture and appearance of said textile fabric thereby creating an aged, distressed appearance in said textile fabric.

14. An apparatus as recited in claim 10, wherein said gas is heated for increasing effectiveness of said modification of texture and appearance of said textile fabric.

15. An apparatus as recited in claim 14, wherein the heated gas is between 150° Fahrenheit to 350° Fahrenheit.

16. An apparatus as recited in claim 10, wherein said gas is steam.

17. A method for modifying the texture and appearance of textile fabric which comprising the steps of:

(a) delivering a textile fabric to a hollow cylinder having an inner surface;

(b) creating a high velocity vortex in the cylinder by means of at least one gas jet directed substantially tangential to the inner surface of the cylinder which thereby causes the textile fabric to rotate with the cylinder and break apart the fiber to fiber bonds within said textile fabric; and (c) removing the textile fabric from the cylinder.

18. A method as recited in claim 17, wherein particles are delivered to the cylinder with the material.

19. A method as recited in claim 18, wherein the particles are sand.

20. A method as recited in claim 18, wherein the particles are metal shot.

21. A method as recited in claim 18, wherein the particles are wire portions.

22. A method as recited in claim 18, wherein the particles are rubber.

23. A method as recited in claim 18, wherein the particles are plastic.

24. A method as recited in claim 18, wherein the particles are wood.

25. A method as recited in claim 17, wherein the gas jet is heated.

26. A method as recited in claim 17, wherein the textile fabric is chemically treated.

27. A method for modifying the texture and appearance of textile fabric which comprising the steps of:

(a) delivering a textile fabric to a plurality of hollow cylinders having interconnecting passages;

(b) creating a plurality of intersecting vortices in the cylinders by means of at least one gas jet directed substantially tangential to the inner surface of at least one of the cylinders which thereby causes the textile fabric to rotate between the cylinders and break apart the fiber to fiber bonds within said textile fabric; and (c) removing the textile fabric from the cylinders.

28. A method as recited in claim 27, wherein particles are delivered to the cylinder with the textile fabric.

29. A method as recited in claim 28, wherein the particles are sand.

30. A method as recited in claim 28, wherein the particles are metal shot.

31. A method as recited in claim 28, wherein the particles are wire portions.

32. A method as recited in claim 28, wherein the particles are rubber.

33. A method as recited in claim 28, wherein the particles are plastic.

34. A method as recited in claim 28, wherein the particles are wood.

35. A method as recited in claim 27, wherein the gas jet is heated.

36. A method as recited in claim 27, wherein the textile fabric is chemically treated.

* * * * *

UNITED STATES PATENT AND TRADEMARK OFFICE

CERTIFICATE OF CORRECTION

PATENT NO. : 5, 363, 599

DATED : November 15, 1994

INVENTOR(S) : Dischler, Louis

It is certified that error appears in the above-identified patent and that said Letters Patent is hereby corrected as shown below:

Column 5, line 46 change "(d)" to "(e)"

Signed and Sealed this

First Day of April, 1997

Bruce Lehman

*Attest:*

BRUCE LEHMAN

*Attesting Officer*

*Commissioner of Patents and Trademarks*